United States Patent [19]

Gebel et al.

[11] Patent Number: 4,675,483

[45] Date of Patent: Jun. 23, 1987

[54] CONTACT ARRANGEMENT FOR VACUUM SWITCHES

[75] Inventors: Rudolf Gebel; Bernt Paul, both of Erlangen, Fed. Rep. of Germany

[73] Assignee: Siemens Aktiengesellschaft, Berlin and Munich, Fed. Rep. of Germany

[21] Appl. No.: 755,371

[22] Filed: Jul. 15, 1985

[30] Foreign Application Priority Data

Sep. 10, 1984 [DE] Fed. Rep. of Germany ..... 3433155
Mar. 1, 1985 [DE] Fed. Rep. of Germany ..... 3507317

[51] Int. Cl.[4] ..... H01H 33/66
[52] U.S. Cl. ..... 200/144 B; 200/147 A
[58] Field of Search ..... 200/144 B, 147 A

[56] References Cited

U.S. PATENT DOCUMENTS 3,082,307 3/1963 Greenwood et al. ..... 200/144 B
4,459,446 7/1984 Wolf ..... 200/144 B
4,516,004 5/1985 Bany et al. ..... 200/144 B
4,532,391 7/1985 Bernt ..... 200/144 B

FOREIGN PATENT DOCUMENTS 3112009 10/1982 Fed. Rep. of Germany ... 200/144 B
3227482 2/1983 Fed. Rep. of Germany ... 200/144 B

*Primary Examiner*—Robert S. Macon

[57] ABSTRACT

An electrical contact arrangement for use in a vacuum switch having two coaxially disposed contact as a contact disk which forms one of the contacts, a contact carrier having side walls forming a cylindrical chamber and having slots spiralling therein about a central axis forming a coil for generating a magnetic field, the walls also serving to support the contact disk so as to span the cylindrical chamber, and a profiled element of ferromagnetic material contained in the chamber and having a face adjacent the contact disk with a cavity therein for evenly radially distributing the magnetic field substantially over the entire contact disk. The profiled element may have a spherical, conical, stepped or rectangular cavity therein, when seen in cross-section, and an additional supporting element of non-magnetic material may be provided within the cavity.

20 Claims, 6 Drawing Figures

CONTACT ARRANGEMENT FOR VACUUM SWITCHES

BACKGROUND OF THE INVENTION

1. Field of the Invention

The present invention relates to a contact arrangement for vacuum switches, and in particular to a contact arrangement for vacuum switches having contacts disposed coaxially opposite each other.

2. Description of the Prior Art

Vacuum switches are known having contacts therein which are coaxially disposed opposite each other and wherein a carrier for one of the contacts has a lateral wall forming a cylindrical chamber, with the lateral wall being provided with a spiralling slot so as to essentially form a coil for generating a coaxial magnetic field.

The presence of a coaxial magnetic field in the gap between the open contacts prevents an increase in the arc voltage, and the high power conversion associated therewith. The coil for generating the magnetic field may cylindrically surround the switching chamber and be connected in series with the switch contacts, thereby generating an axial magnetic field dependent on the current which permeates the gap between the contacts. The coil may be constructed multi-ply for increasing the field strength in the contact gap. The manufacture of vacuum switches in this manner, however, requires a relatively high components outlay.

Another type of contact arrangement is known having two essentially cylindrical contacts disposed coaxially relative to each other, with the surfaces of the contacts being in the form of a helical line having the same rotational sense in both contacts, and which are supplied with current in the same direction by the same source as the current which is to be switched. As a consequence of the shape of the surface of the contacts, which is similar to a torsion bar, an azimuthal component of the current is obtained which generates an axial magnetic field between the contacts. The field strength of this magnetic field effects a diffuse arc shape. In order to concentrate this field within the contact gap, the contacts each contain a coaxial core of ferro-magnetic material. As a result of these iron cores, a magnetic field is concentrated in the contact gap which decreases in the radial direction proceeding from the central contact axis. A switching arrangement of this type is described in German OS No. 31 12 009.

Another conventional type of contact arrangement employs substantially shell-shaped cup contacts having contact carriers surrounding a cylindrical chamber, forming the lateral walls of the chamber, and being covered by the contact disk. The axial field is obtained by slanted slots in the contact carriers which are inclined relative to the axis, having the same rotational sense in both contacts. A supporting member is provided between the contact disk and the base of the contact, the supporting member consisting of sheets of ferro-magnetic material which are substantially radially disposed. The supporting member thus also effects a field concentration in the region of the contacts close to the central axis. A contact arrangement of this type is described in German OS No. 32 27 482.

SUMMARY OF THE INVENTION

It is an object of the present invention to provide a contact arrangement for a vacuum switch having a substantially homogeneous magnetic field between the open contacts by a selectively shaped profile member.

The above object is inventively achieved based on the perception that field concentration in the region close to the axis must be avoided, and a high degree of homogenization of the axial magnetic field in the radial direction between the open contacts up to the proximity of the contact edges is desirable. This magnetic field distribution is obtained by a profiled element situated in the chamber formed in one of the contacts having a cavity in a face thereof adjacent the contact. An intensification of the magnetic field in the radial direction up to the edge of the contacts, and thus a magnetic field distributed roughly uniformly over the diameter of the contacts is obtained by means of the ferro-magnetic profile members. The cavity in the profiled member may be in the form of a radial or conical recess, when seen in cross-section, or may be stepped or rectangular in cross-section. The cavity is substantially uniformly disposed with respect to the central contact arrangement axis. A non-magnetic supporting member may also be disposed within the profiled element under certain conditions.

As a consequence of the reduction of the outside diameter of the ferro-magnetic profiled member beneath the contact disk, an unwanted electrical shunt due to inadvertent or unavoidable contact with the interior wall of the slotted contact carrier can be substantially minimized or avoided altogether. A mechanically stable, electrically insulating support of the profiled member at the side of the contact carrier base can be provided by means of a flat ring consisting insulating material.

As stated above, a centrally disposed non-magnetic supporting member may be disposed between the contact disk and the profiled face of the profiled member. Forces which would otherwise stress the contact disk and the contact carrier can thus be accommodated. A profiled member in the form of a ring may also be provided, preferably surrounding the supporting member and being separated under certain conditions from the contact base by an electrically insulating intermediate layer.

As a resuit of the reduction of the diameter of the supporting member in comparison to the interior diameter of the ferro-magnetic profiled member, the electrically conductive contact of the supporting member and the profile member can be limited to a narrow region. As a result thereof, the profiled member functions as an electrical short circuit for the slotted contact carrier functioning as a coil. In order to suppress eddy currents, the profiled member may be provided with radial slots. At the bottom face thereof facing the base of the contact, the profiled member may be provided with at least one elevation in the form of an annular disk which serves as a seating surface on the base of the contact. Thus forces acting through the contact disk on the profiled member are transmitted to the base of the contact, and at the same time an electrical shunt current through the profiled member is limited. That face of the profiled member facing the contact disk may be provided with a flanged edge or rim projecting into a complementary recess in the contact carrier forming the walls of the cylindrical chamber. As a result thereof, a mechanical support for the profile member is obtained. In a further embodiment, the flange may project into the contact carrier so far that the magnetic field is also significantly increased as a result thereof in the region of the edge of the contact disk.

DESCRIPTION OF THE PREFERRED EMBODIMENTS

Figure 1:
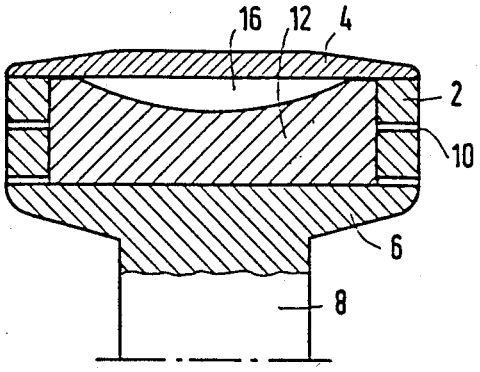
FIG. 1 a cross-sectional side view of a contact arrangement constructed in accordance with the principles of the present invention.

A cross-sectional view of a contact arrangement constructed in accordance with the principles of the present invention for vacuum switches is shown in FIG. 1. Only one contact is shown therein, having a cylindrical contact carrier 2, a contact disk 4, and a contact base 6 which is secured to a power lead 8 by means of a cylindrical pin. The contact carrier 2 is provided with spiralling slots inclined relative to the rotational axis (not shown in FIG. 1 but reference 31 in FIG. 5) of the contact so that the portions of the contact carrier 2 between the slots form a coil element for the current. These slots are inclined in the same direction with another contact (not shown in FIG. 1) of the contact arrangement, so that an axial magnetic field is generated within the gap between the open contacts.

The contact carrier 2 forms the side wall of a hollow cylindrical chamber which receives a ferro-magnetic profiled member 12. The profiled member 12 has a cavity 16 in the face thereof adjacent the contact disk 4. In the embodiment of FIG. 1 this cavity 16 is in the form of a spherical recess, however a conical recess may also be employed. As a result of this selectively profiled member, the axial magnetic field is extended in the radial direction and thus the magnetic field is distributed substantially uniformly over the entire diameter of the contact disk 4.

Figure 2:
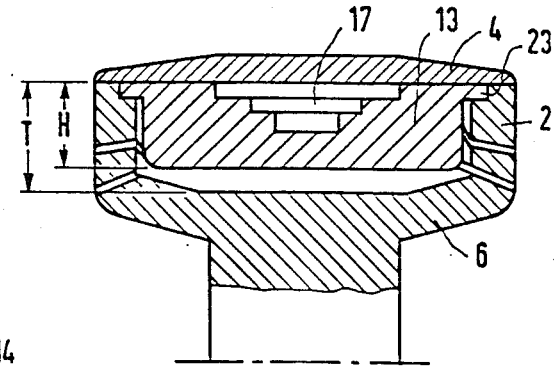
FIG. 2 is a cross-sectional side view of a further embodiment of a contact arrangement constructed in accordance with the principles of the present invention.

In a furtner embodiment of the contact arrangement shown in FIG. 2, a profiled member 13 is provided having a face adjacent the contact disk 4 with a stepped cavity 17, the steps increasing in diameter as they become closer to the contact disk 4. In this embodiment, the profiled member 13 is also provided with a flange 23 extending around an upper rim thereof which projects into a complementary recess in the carrier 2. This flange 23 functions to mechanically support the profiled element 13, rather than resting directly on the base 6. It will be understood that the flange 23 may be utilized in the embodiment of FIG. 1 with the spherical cavity, and the spherical cavity may be used in the embodiment of FIG. 2 employing the flange 23.

As further shown in FIG. 2, the height H of the profiled member 13 is less than the depth T of the chamber formed by the contact base 6 and the carrier 2. Moreover, the outside diameter of the profiled member 13 may be dimensioned slightly smaller than the interior diameter of the carrier 2. In this embodiment, therefore, a short circuit of the current through the profiled member 13 is substantially impossible.

Figure 3:
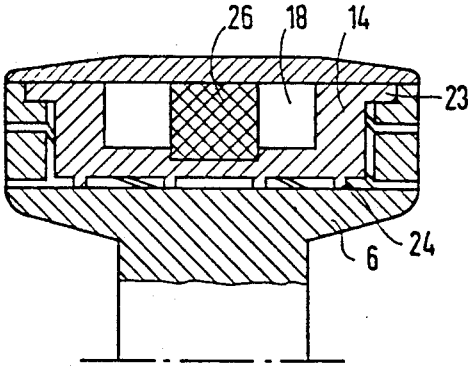
FIG. 3 is a cross-sectional side view of a contact arrangement constructed in accordance with the principles of the present invention having a supporting member therein.

A further embodiment of a profiled member 14 is shown in FIG. 3 having a cavity 18 in which a supporting member 26, comprised of material which is at least poorly electrically conductive and non-magnetic, is disposed. At the bottom of the profiled member 14 facing the base 6 of the contact, the profiled member 14 has annular projections 24 on which the profiled member 14 rests against the base 6. These projections 24 further reduce the seating or contacting surface of the profiled member 14 on the base 6, thus considerably reducing the possibility of a current short circuit through the profiled member 14 to the base 6.

Figure 4:
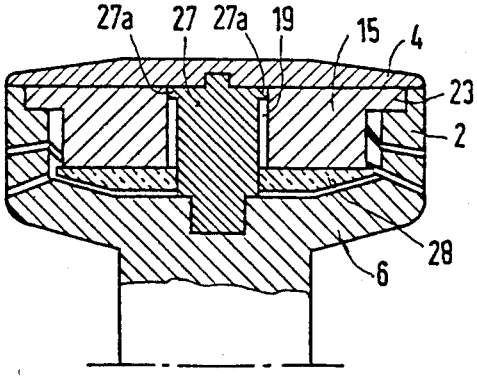
FIG. 4 is a cross-sectional side view of a further embodiment of a contact arrangement constructed in accordance with the principles of the present invention having a supporting element therein.

Another embodiment shown in FIG. 4 wherein a substantially annularly profiled member 15 is provided, which surrounds an additional supporting member 27 in the center thereof. The supporting member is again comprised of non-magnetic material such, for example, stainless steel, and under certain conditions may be comprised of electrically insulating material such as, for example, ceramic. An electrical short circuit of the current through the profiled member 15 is prevented by an electrically insulating intermediate layer 28 in the form of an annular disk. The outside diameter of the supporting member 27 is slightly smaller than the interior diameter of the profiled member 15, so that an electrically conductive contact between the supporting member 27 and the profiled member 15 is limited to a narrow region beneath the contact disk 4 formed by an annular flange 27*a*. The flange 23 of the profiled member 15 again projects into the contact carrier 2 to such an extent that the axial magnetic field is increased in the region of the outside edge of the contact disk 4. Any shunt which may be caused by the non-magnetic supporting member 27 amounts to only approximately 5% of the total current.

Figure 5:
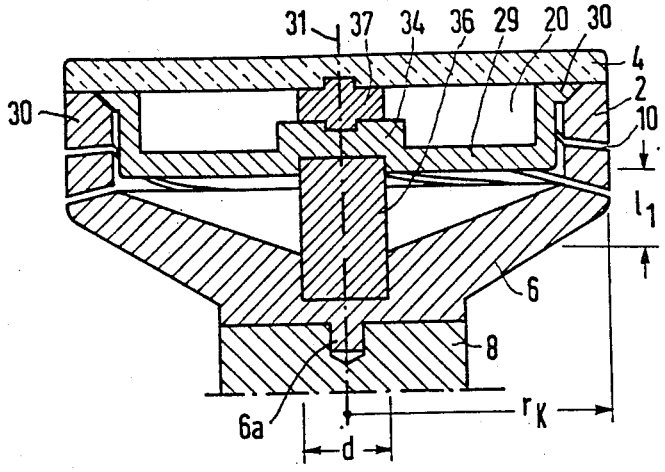
FIG. 5 is a cross-sectional side view of yet another embodiment of a contact arrangement constructed in accordance with the principles of the present invention having a supporting element therein.

Another embodiment is shown in FIG. 5 wherein the contact carrier 2 again forms the side wall of a cylindrical chamber receiving a profiled member 29 having a cavity 20. The profiled member 29 is essentially shell-like, but is provided with a land 34 in a central region thereof surrounding the axis 31. A reduced so-called "pole shoe spacing" results in the region close to the axis for the axial magnetic field due to the land 34, thus resulting in a more uniform current load of the contact surface and a correspondingly increased breaking capacity of the contact arrangement. Supporting members 37 and 36 are provided on opposite sides of the land 37. These supporting elements are essentially coaxial along the axis 31 and are comprised of non-magnetic material which has poor electrical conductivity, such as stainless steel. The pin 6*a* connecting the base 6 to the power lead 8 is shown in FIG. 5.

The preferably cylindrical supporting member 36 connected to the base 6 of the contact arrangement is preferably dimensioned such that its resistance is high for the axial current direction in comparison to the resistance $R_{sp}$ of the contact carrier 2, functioning as an axial field core. For this purpose, the free length $l_1$ of the supporting member 36 is selected to satisfy the following condition:

$$l_1 >> (\pi/4)\cdot\sigma\cdot d^2\cdot R_{sp}$$

In the above expression, the term $\sigma$ denotes the electrical conductivity of the supporting member 36, and d is its diameter. Given a supporting member 36 of chrome-nickel steel having an electrical conductivity $\sigma = 1.4$ $Sm/mm^2$ and a diameter $d = 13$ mm and a coil resistance $R_{sp} = 2.3\ \mu\Omega$, $l_1$ must be selected for greater than 0.43 mm. In the embodiment of FIG. 5 wherein the outside diameter of the contact is approximately $2\cdot r_k = 100$ mm, the length $l_1$ of 13 mm meets this condition. The resistance of the supporting member 36 over the length $l_1$ thereby amounts to 70 $\mu\Omega$, so that less than 3% of the overall current can flow through the supporting member 36, and thus more than 97% of the total current can be exploited for generating the axial field.

Figure 6:
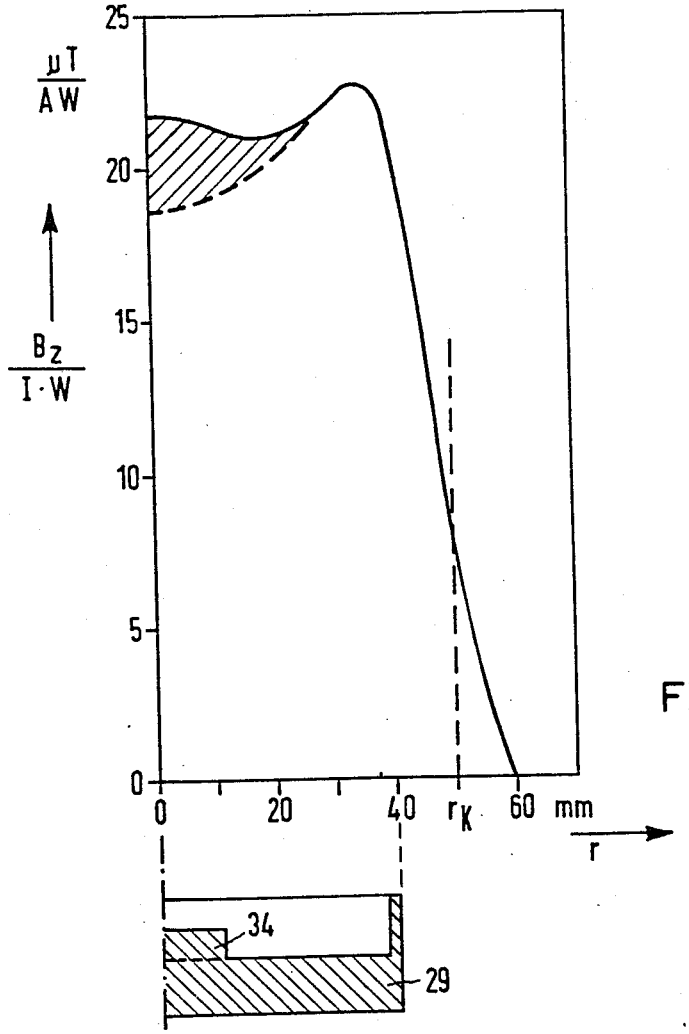
FIG. 6 is a graph showing the magnetic field strength as a function of the distance along the profiled member from the central axis of the contact arrangement shown in FIG. 5.

In the graph shown in FIG. 6, the axial magnetic induction $B_z$ generated in the gap between the opened contacts per ampere winding count (I·W) is entered on the vertical axis in $\mu T/A.W$ dependendet upon the radius r. The profiled member 29 is shown beneath the graph in FIG. 6 to reference the shape of the profiled member 29 to the magnetic field strength. The field path or distribution of a profiled member without the land 34 is indicated in FIG. 6 with the dashed line in the region close to the central axis. It is clear that a more uniform field distribution is obtained between the open contacts with the profiled member 16 including the land 34 close to the axis.

In the embodiments of the apparatus having respective profiled members 12 through 16, the angle of inclination of the slots 10 can be selected smaller than in conventional arrangements without the ferro-magnetic profiled member. The outlay for manufacturing the slots 10 is correspondingly reduced. The added outlay for manufacturing the ferro-magnetic profiled members 12 through 16, and the insulating ring 28, is thus partially compensated.

Although modifications and changes may be suggested by those skilled in the art it is the intention of the inventors to embody within the patent warranted hereon all changes and modificatons as reasonably and properly come within the scope of their contribution to the art.

We claim as our invention:

1. An electrical contact arrangement for use in a vacuum switch having two coaxially disposed contacts having an air gap therebetween when opened, said contact arrangement comprising:

a contact disk forming one of said contacts;

a contact carrier having side walls forming a chamber therein, said side walls having slots spiralling about a central axis of said chamber and extending therethrough forming a coil for generating a magnetic field, and supporting said contact disk so as to span said chamber, and a profiled element consisting of ferro-magnetic material received in said chamber and having a face adjacent said contact disk with a cavity therein shaped for minimizing concentraction of said magnetic field in said air gap after said contacts are opened thereby substantially evenly radially distributing said magnetic field over said contact disk.

2. A contact arrangement as claimed in claim 1 wherein said cavity in said profiled element has a spherical cross-section.

3. An electrical contact arrangement as claimed in claim 1 wherein said cavity of said profiled element has a rectangular cross-section.

4. An electrical contact arrangement as claimed in claim 1 wherein said cavity in said profiled element has a stepped cross-section, with steps increasing in extent closer to said contact disk.

5. An electrical contact arrangement as claimed in claim 1 further comprising a supporting element consisting of non-magnetic material disposed in said cavity for mechanically supporting at least a portion of said contact disk.

6. An electrical contact arrangement as claimed in claim 1 further comprising a base on which said carrier support rests and which forms a bottom of said chamber, and wherein said profiled element rests directly on said bottom of said chamber.

7. An electrical contact arrangement as claimed in claim 1 further comprising a base on which said contact carrier rests forming a bottom of said chamber, and wherein said profiled element has an upper flange extending therefrom and said contact carrier has a complementary recess receiving said flange for mechanically supporting said profiled element spaced from said bottom of said chamber.

8. An electrical contact arrangement as claimed in claim 7 further comprising an electrically insulating layer disposed between a bottom of said profiled element and said bottom of said chamber.

9. An electrical contact arrangement as claimed in claim 7 further comprising a plurality of ridges extending from a bottom of said profiled element and in contact with said bottom of said chamber for supporting said profiled element thereon.

10. An electrical contact arrangement as claimed in claim 1 further comprising a supporting element received in said cavity of said profiled element, said supporting element having an exterior diameter which is substantially less than the interior diameter of said cavity.

11. An electrical contact arrangement as claimed in claim 1 wherein said chamber is cylindrical and wherein said profiled element is cylindrical and has a central axial cylindrical cavity therein.

12. An electrical contact arrangement as claimed in claim 1 wherein said cavity of said profiled element has a centrally disposed land and further comprising a first support element disposed between a bottom of said chamber and said profiled element and a second support element disposed between said profiled element and said contact disk.

13. An electrical contact arrangement as claimed in claim 12 wherein said first and second supporting elements consist of non-magnetic material having poor electrical conductivity.

14. An electrical contact arrangement as claimed in claim 12 wherein at least said first supporting element is cylindrical, and wherein said first supporting element has a length $l_1$ selected such that $l_1 >> \pi/4\cdot\sigma\cdot d^2\cdot R_{sp}$, wherein $\sigma$ is the electrical conductivity of said first supporting element, d is the diameter of said first supporting element, and $R_{sp}$ is the electrical resistance of said contact carrier.

15. An electrical contact assembly comprising:

a contact element forming an air gap in said assembly in one switching position;

means for generating a magnetic field supporting said contact element and having a chamber therein spanned by said contact element; and means received in said chamber having a selected profile shaped for minimizing concentration of said magnetic field in said air gap thereby substantially evenly radially distributing said magnetic field substantially over the entire contact element.

16. An electrical contact assembly as claimed in claim 15 wherein said selected profile is a cavity disposed in a face of said means received in said chamber adjacent to said contact element.

17. An electrical contact assembly as claimed in claim 16 further comprising a supporting element disposed in said cavity between said means in said chamber and said contact element for mechanically supporting at least a portion of said contact element.

18. An electrical contact assembly comprising:

means for generating a magnetic field having a rim surrounding an opening therein;

a contact element supported on said rim covering said opening; and a field distributing element disposed in said opening having a surface adjacent said contact element selected for substantially evenly radially distributing said magnetic field over said contact element.

19. An electrical contact assembly as claimed in claim 18 wherein said surface of said field distributing element adjacent said contact element is a profiled surface having a cavity therein.

20. An electrical contact assembly as claimed in claim 19 further comprising a support element disposed in said cavity for mechanically supporting at least a portion of said contact element.

* * * * *